US012408759B2

(12) United States Patent
Reid

(10) Patent No.: US 12,408,759 B2
(45) Date of Patent: Sep. 9, 2025

(54) SELF-RETRACTABLE STEP

(71) Applicant: Dickson24 Inc., Westmount (CA)

(72) Inventor: Frédérick Reid, Montreal (CA)

( * ) Notice: Subject to any disclaimer, the term of this patent is extended or adjusted under 35 U.S.C. 154(b) by 0 days.

(21) Appl. No.: 17/530,644

(22) Filed: Nov. 19, 2021

(65) Prior Publication Data

US 2022/0071399 A1 Mar. 10, 2022

Related U.S. Application Data

(63) Continuation of application No. 17/122,337, filed on Dec. 15, 2020, now Pat. No. 11,202,512, which is a continuation of application No. PCT/CA2019/051516, filed on Oct. 25, 2019.

(60) Provisional application No. 62/750,858, filed on Oct. 26, 2018.

(51) Int. Cl.
*A47C 12/00* (2006.01)
*A47C 9/06* (2006.01)

(52) U.S. Cl.
CPC ..... *A47C 12/00* (2013.01); *A47C 9/06* (2013.01)

(58) Field of Classification Search
CPC ..... A47C 12/00; A47C 12/02; A47C 9/00; A47C 9/06; A47C 11/02; A47C 16/04; A47B 77/00; A47K 17/02; A47K 17/028
See application file for complete search history.

(56) References Cited

U.S. PATENT DOCUMENTS 1,428,018 A * 9/1922 Erickson ..... A47C 7/56 297/332
1,682,732 A * 9/1928 Beard ..... A47C 12/02 182/33.6

(Continued)

FOREIGN PATENT DOCUMENTS

DE 3439391 A 4/1986
JP H07265231 A 10/1995
WO WO-2017124180 A1 * 7/2017 ..... A47K 17/00

OTHER PUBLICATIONS

International patent application No. PCT/CA2019/051516 International Preliminary report on patentablitity dated Nov. 10, 2020.

(Continued)

*Primary Examiner* — Colleen M Chavchavadze
(74) *Attorney, Agent, or Firm* — Anglehart et al.

(57) ABSTRACT

A self-retractable step for assisting a user in elevating him or herself above a floor, is disclosed. The self-retractable step comprises a self-retractable foot member and a cylindrical assembly coupled with the self-retractable foot member. The foot member is configured to move from one position to another position. The cylindrical assembly comprises a rotary member, one or more spring members and a protuberance member. The rotary member is configured to move the foot member to a predetermined position. Further, the spring members coupled to the rotary member is configured to self-retract the foot member from the predetermined position. The protuberance member disposed at the cylindrical assembly is configured to act as a stopper to hold the foot member in a predetermined position on retraction by the spring members. The self-retractable step further comprises a load bearing member at a base of the foot member.

20 Claims, 12 Drawing Sheets

(56) References Cited

U.S. PATENT DOCUMENTS

| | | | | | |
|---|---|---|---|---|---|
| 1,821,517 | A * | 9/1931 | Hyatt | A47C 12/02 | 182/33.6 |
| 1,946,747 | A | 2/1934 | Laborda | | |
| 2,158,949 | A | 5/1939 | Sarles et al. | | |
| 2,530,625 | A * | 11/1950 | Nordmark | A47C 7/566 | 297/331 |
| 2,570,865 | A | 10/1951 | Sabo | | |
| 2,575,615 | A | 11/1951 | Crump | | |
| 2,746,664 | A | 5/1956 | Strmic | | |
| 2,858,056 | A | 10/1958 | Ownby | | |
| 2,873,056 | A | 2/1959 | Gratton | | |
| 2,881,040 | A | 4/1959 | Hartridge | | |
| 3,030,166 | A * | 4/1962 | Baker | A47B 77/10 | 312/235.1 |
| 3,589,762 | A * | 6/1971 | Henrikson | A47C 7/56 | 297/331 |
| 3,986,503 | A | 10/1976 | Le Guillon | | |
| 4,135,604 | A | 1/1979 | Ryan | | |
| 4,139,391 | A | 2/1979 | Ikeda et al. | | |
| 4,462,486 | A | 7/1984 | Dignan | | |
| 4,652,003 | A * | 3/1987 | Karashima | B62B 5/085 | 182/15 |
| 4,924,970 | A | 5/1990 | Seals et al. | | |
| 5,048,639 | A * | 9/1991 | Scherer | B63B 29/00 | 182/129 |
| 5,094,515 | A | 3/1992 | Low | | |
| 5,358,067 | A | 10/1994 | Ford et al. | | |
| 5,730,388 | A | 3/1998 | Alder et al. | | |
| 5,819,670 | A | 10/1998 | O'Connor et al. | | |
| 5,967,255 | A | 10/1999 | Young | | |
| 6,293,621 | B1 * | 9/2001 | Marsh | A47C 7/566 | 297/335 |
| 6,659,224 | B2 | 12/2003 | Medsker | | |
| 7,303,235 | B1 * | 12/2007 | Fongers | A47C 1/16 | 52/9 |
| 7,716,757 | B2 | 5/2010 | Sumpton et al. | | |
| 8,037,557 | B2 | 10/2011 | Sumpton et al. | | |
| 8,157,053 | B1 | 4/2012 | Lameiro | | |
| 8,925,682 | B2 | 1/2015 | Chitayat et al. | | |
| 9,480,342 | B2 | 11/2016 | White | | |
| 9,573,609 | B2 * | 2/2017 | Yu | E06C 7/182 | |
| 9,611,691 | B1 | 4/2017 | Hunter et al. | | |
| 9,617,788 | B2 * | 4/2017 | Goodson | E06C 1/005 | |
| 10,184,293 | B1 * | 1/2019 | McCalib, Jr. | E06C 9/12 | |
| 10,390,668 | B1 * | 8/2019 | Ryder | A47K 17/028 | |
| 10,426,301 | B2 | 10/2019 | Sumpton et al. | | |
| 2011/0024246 | A1 * | 2/2011 | Mitjans | A47C 7/566 | 188/297 |
| 2012/0234630 | A1 * | 9/2012 | Havens | A47C 12/00 | 182/223 |
| 2015/0001005 | A1 | 1/2015 | Goodson | | |
| 2017/0370148 | A1 | 12/2017 | Smith | | |
| 2019/0024455 | A1 | 1/2019 | Reid et al. | | |

OTHER PUBLICATIONS

International patent application No. PCT/CA2019/051516 International Search Report dated Feb. 17, 2020.

International patent application No. PCT/CA2019/051516 Search Strategy dated Feb. 17, 2020.

International patent application No. PCT/CA2019/051516 Written Opinion of the International Searching Authority dated Feb. 17, 2020.

Canadian application No. 3,116,904 Office Action dated May 12, 2021.

European application No. 19877310.3 the extended European search reportdated Nov. 22, 2021.

Corresponding European application No. 19877310.3 Communication about intention to grant a European patent dated Jul. 7, 2023 with the allowed claims.

* cited by examiner

SELF-RETRACTABLE STEP

CROSS-REFERENCE TO RELATED APPLICATIONS

The present application is a continuation application of U.S. patent application Ser. No. 17/122,337 filed Dec. 15, 2020, now allowed, which, in turn, is a continuation application of International Application No. PCT/CA2019/051516 filed 25 Oct. 2019 designating the United States, that claims priority of U.S. provisional patent application Ser. No. 62/750,858 filed 26 Oct. 2018, the contents of which is hereby incorporated by reference.

BACKGROUND OF THE INVENTION

A. Technical Field

The present application generally relates to a floor mounted retractable step. More specifically, the present application relates to a self-retractable step for assisting a user in elevating him or herself above a floor, particularly to access a sink.

B. Description of Related Art

Handwashing greatly contributes to public health. However, sinks are inaccessible to low height persons in virtually all public washrooms as very few of them are equipped with elevating devices or low sinks. Low height persons are little people and small children. If parents want their children to wash their hands in public restrooms, they have to lift and squeeze them between themselves and the countertop in order to raise the child to the right height. This uncomfortable arrangement is strenuous both to the child who is being held in a strained position and to the parent who has to lift the child. More often than not, little people are not accompanied by a taller person who can lift them, so there is no way for them to use sinks in public restrooms. Few prior-art references addressing the foregoing issues are discussed as follows.

U.S. Pat. No. 9,611,691 of John Scott Hunter et al. discloses an in-cabinet step stool. The in-cabinet step stool for use with a cabinet defines an interior area, the in-cabinet step stool includes a framework having a pair of upstanding side walls, each side wall having a rear section and a front section extending forwardly and downwardly from the rear section. An upper step spans between upper edges of respective rear sections. A lower step spans between upper edges of respective lower sections. Each includes a rear foot having a rounded configuration such that the framework is pivotally movable thereon between a deployed configuration in which the rear foot rests upon the bottom wall of the cabinet and the front section extends forwardly through the opening of the cabinet and a stored configuration in which the rear foot rests upon the bottom wall of the cabinet and the front section is inside the cabinet interior area. The in-cabinet step stool is necessarily designed to be installed in a cabinet under a sink, where a bottom wall of the cabinet is higher than the floor in front of the sink. As shown in FIG. 5 of U.S. Pat. No. 9,611,691, this configuration adds to the required height of the step stool because the front feet must reach the floor while the rear feet are disposed on the bottom cabinet wall. This makes the step stool bulky. Further, the step stool is pulled out of the cabinet and returned to the cabinet using a hand-operated mechanism. This forces a user to touch a surface in a bathroom which may not be hygienic.

U.S. Pat. No. 2,881,040 of Hartridge Virginia Masden discloses a disappearing and slidable step-chair for kitchen cabinets and the like. A recessible combination step ladder and chair has been provided, which is adapted to he slid along the front of a kitchen counter on a guide track for access to any one of a plurality of upper cabinets and which is also adapted to be pivoted about said track for being recessed within one of the counter cabinets for storage. Even though, the prior art references provide functionality to assist the user in elevating him or herself above the floor, they lack to provide optimal functionality to the user and also the used needs to move the device to storage position manually. Further, they are installed in the cabinet.

Henceforth, there is a need to provide a self-retractable step comprising an economical design for assisting a user in elevating him or herself above a floor.

SUMMARY OF THE INVENTION

The present application discloses a self-retractable step for assisting a person in elevating him or herself above a floor, particularly to access a sink.

According to the present application, the self-retractable step comprises a self-retractable foot member and a cylindrical assembly coupled with the self-retractable foot member. The foot member is configured to move from one position to another position. In one embodiment, the foot member is configured to move between a vertical position or rest position and a horizontal position or deployed position. The cylindrical assembly comprises a rotary member, one or more spring members and a protuberance member. The rotary member is configured to move the foot member to a predetermined position. In one embodiment, the rotary member is configured to move the foot member to the horizontal position.

Further, the spring members coupled to the rotary member is configured to self-retract the foot member from the predetermined position. In one embodiment, the spring members is configured to self-retract the foot member from the horizontal position to the vertical position. The protuberance member disposed at the cylindrical assembly is configured to act as a stopper to hold the foot member in a predetermined position on retraction by the spring members. In one embodiment, the protuberance member is configured to act as a stopper to hold the foot member in the vertical position on retraction by the spring members. The self-retractable step further comprises a load bearing member at a base of the foot member. In one embodiment, the load bearing member is configured to hold the foot member above ground level on horizontal position. In one embodiment, the foot member is a stair member comprising at least two steps.

In some embodiments, the present disclosure relates to a self-retractable step which may include a foot member and a cylindrical assembly. The foot member may include at least two steps and a load bearing member disposed on a base of the foot member. The cylindrical assembly may be coupled to the foot member and mountable on a floor, and may include a rotary member configured to move the foot member between a horizontal position and a vertical position.

The self-retractable assembly of the present disclosure may include any of the following features independently or in any combination. The cylindrical assembly may include one or more spring members configured to retract the foot member and the one or more spring members may be attached to the rotary member. One or more wheels may be provided between the spring members and the cylindrical assembly and each of the wheels may have one or more holes, wherein the wheels are configured to vary the strength of the spring members. The spring members may be configured to retract the foot member from the horizontal position to the vertical position. The cylindrical assembly may include a protuberance member configured to act as a stopper to hold the foot member in a predetermined position. The self-retractable step may be configured such that deployment of the foot member is performed by placing the foot and pressing downward on at least one step. The at least two steps of the foot member may include an upper step and a lower step, and wherein a depth of the lower step is less than a depth of the upper step. The load bearing member may be recessed from a front edge of the foot member.

In some embodiments, the present disclosure relates to a self-retractable step which may include a foot member and a rotation assembly. The foot member may include at least a first step and a second step, and a load bearing member disposed on a base of the foot member. The rotation assembly may be coupled to the foot member and configured to be mounted on a fixed horizontal surface. The rotation assembly may include a rotary member configured to allow the foot member to rotate from a use position to a rest position relative to the fixed surface.

The self-retractable assembly of the present disclosure may include any of the following features independently or in any combination. The rotation assembly may include a retraction mechanism configured to retract the foot member from the use position to the rest position. The retraction mechanism may include one or more biasing members and/or a motor. The rotation assembly may include one or more dampeners attached to the biasing members. The cylindrical assembly may be configured to support a load applied via the foot member. The first step may have a height of ten inches and a depth of six inches and the second step may have a height of five inches and a depth of four inches. The rotation assembly may include a stopper to hold the foot member in the rest position. The rotation assembly may have a curved upper surface and the foot member may have a curved surface which mates with the curved upper surface of the rotation assembly. A depth of the first step may be between 50% and 80% of a depth of the second step. The load bearing member may be disposed at a distance from a front edge of the foot member and at a distance from two side edges of the foot member. The foot member may include an angled front edge, angled such that a user can read instructions displayed on the angled front edge when the foot member is in a rest position.

In some embodiments, the present disclosure relates to a system comprising a floor, a sink, and a self-retractable step moon the floor, such that a foot member of the self-retractable step is entirely disposed at least three inches behind a front edge of the sink in a rest position. The self-retractable step may have any of the features described above.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1A:
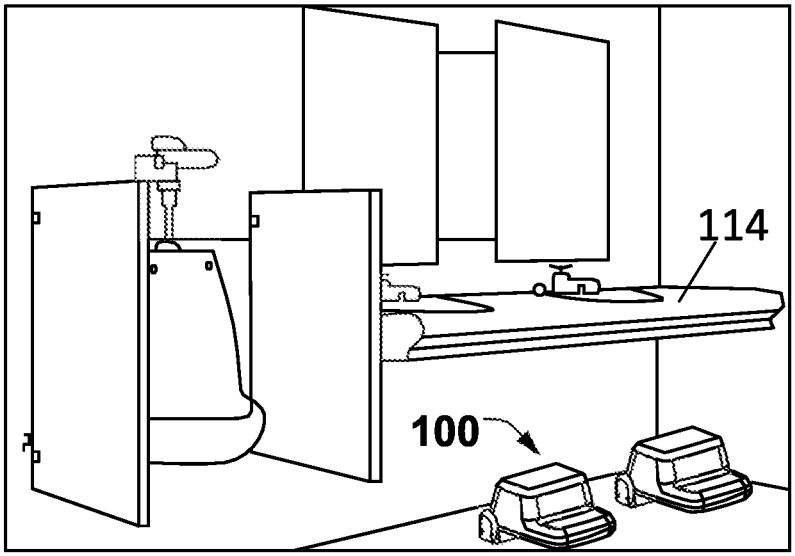
FIG. 1A exemplarily illustrates a self-retractable step installed beneath a sink, according to one embodiment of the present invention.
Figure 1B:
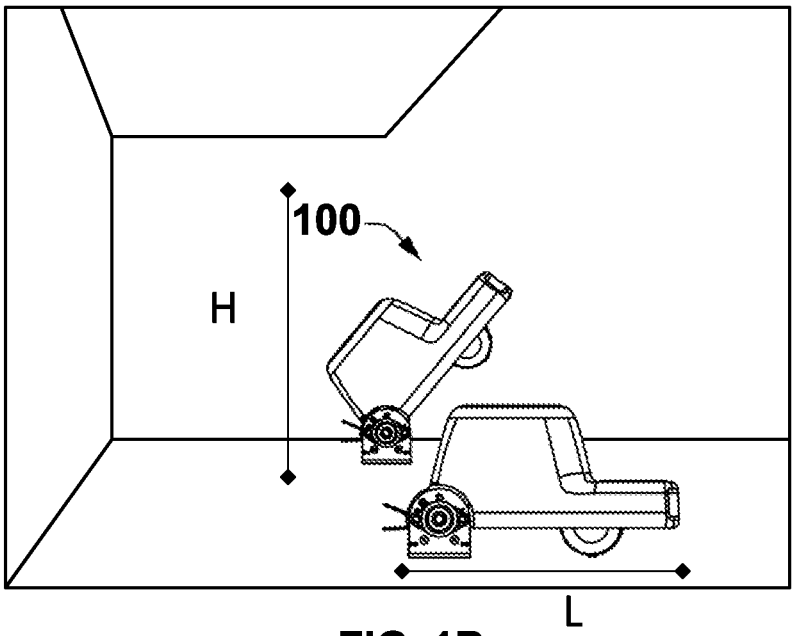
FIG. 1B exemplarily illustrates operation of at two self-retractable steps installed beneath the sink, according to one embodiment of the present invention.
Figure 2:
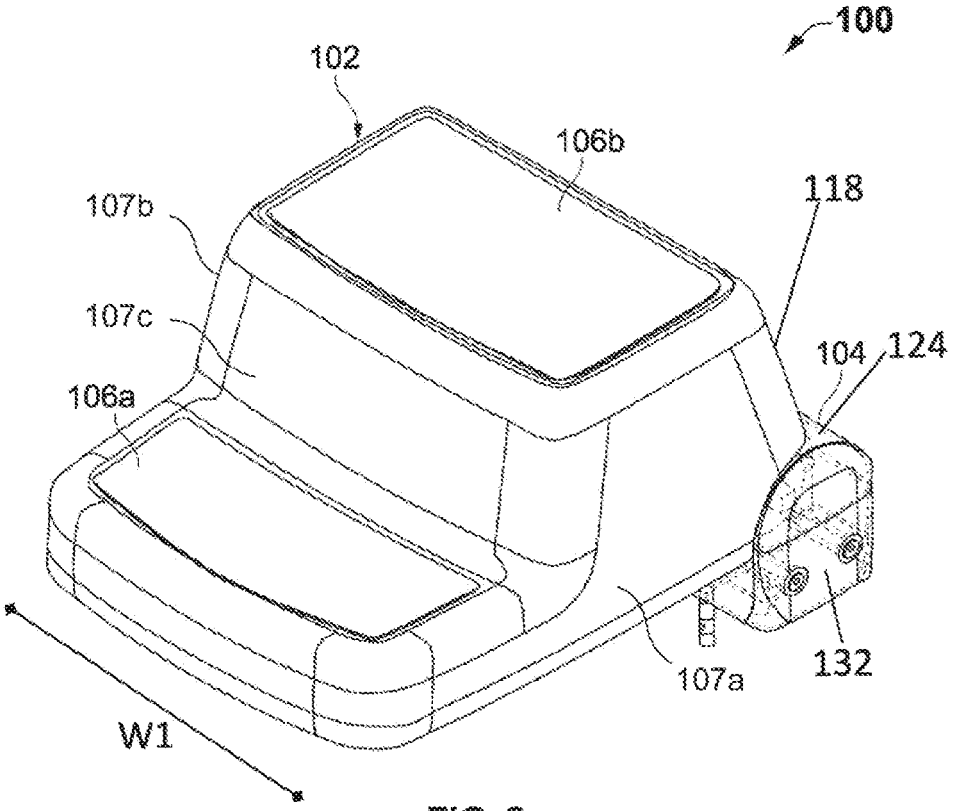
FIG. 2 exemplarily illustrates a perspective view of the self-retractable step, according to one embodiment of the present invention.

Referring to FIG. 1A and FIG. 1B, the present invention discloses a self-retractable step 100 for assisting a user in elevating him or herself above a floor. Referring to FIG. 2, according to the present invention, the self-retractable step 100 comprises a self-retractable foot member 102 and a cylindrical assembly 104 coupled to the foot member 102. In one embodiment, the self-retractable foot member 102 is configured to move from one position to another position. In one embodiment, the foot member 102 is configured to move to a predefined position via a rotary member of the cylindrical assembly 104. Further, the foot member 102 is configured to retract from the predefined position automatically via one or more spring members 112 of the cylindrical assembly 104.

In another embodiment, the foot member 102 is configured to move between a vertical position and a horizontal position. In one embodiment, the foot member 102 is configured to move to the horizontal position via the rotary member of the cylindrical assembly 104. Further, the foot member 102 is configured to retract to the vertical position or rest position automatically via the spring members 112 of the cylindrical assembly 104.

Figure 3:
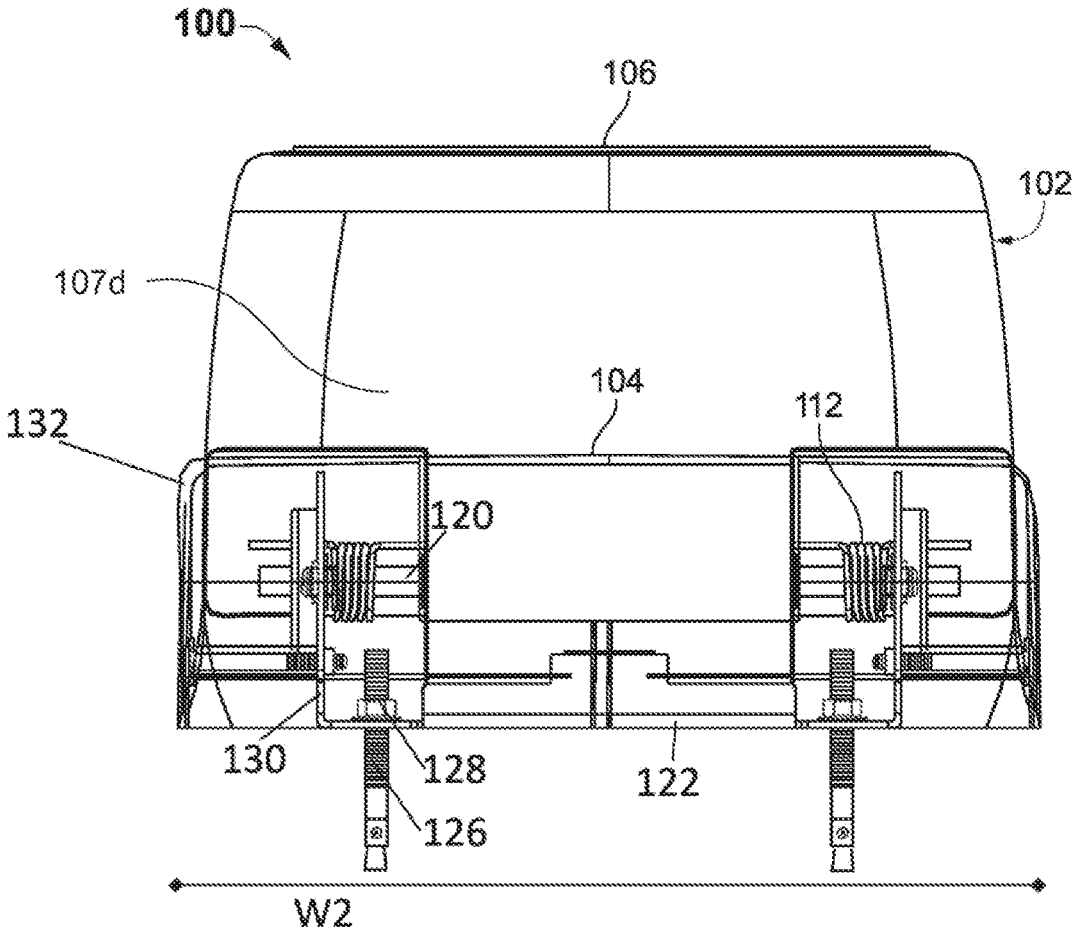
FIG. 3 exemplarily illustrates a rear view of the self-retractable step, according to one embodiment of the present invention.

Referring to FIG. 2, the foot member 102 is a stair member comprising at least two steps 106, two side panels 107*a* and 107*b*, at least one front panel 107*c* located between at least two steps 106, one back panel 107*d* (see FIG. 3) and one bottom panel 107*e* (see FIG. 6A) to form a closed body. In one embodiment, the foot member 102 is displaced from the vertical position to the horizontal position by placing a foot upon at least one step 106 of the stair member. Referring to FIG. 3, the cylindrical assembly 104 coupled to the self-retractable foot member 102 is illustrated.

Figure 4:
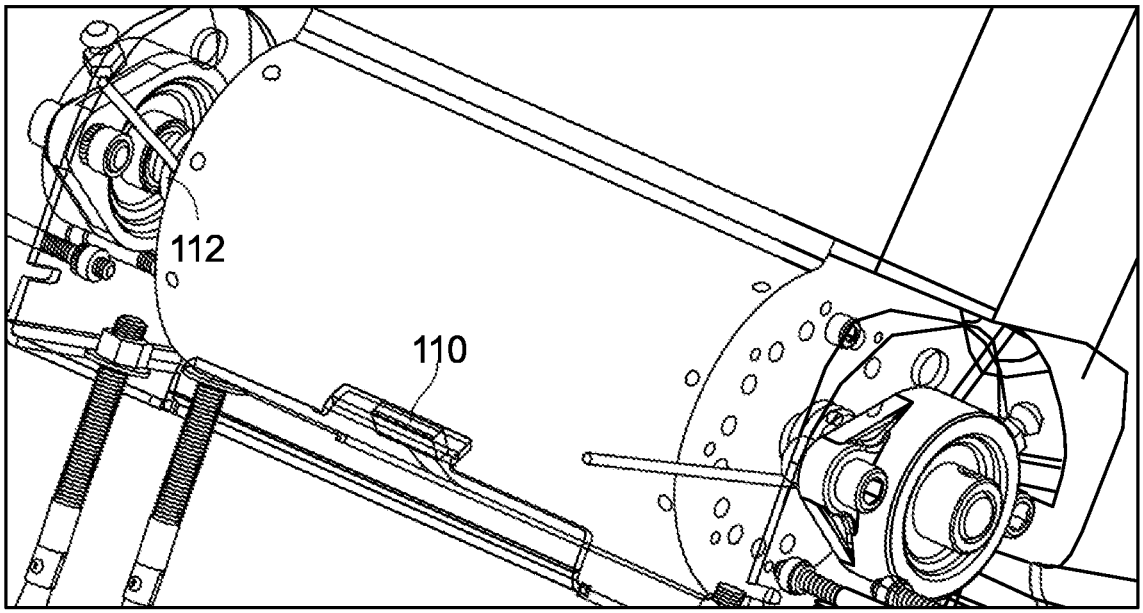
FIG. 4 exemplarily illustrates a perspective view of a cylindrical assembly, according to one embodiment of the present invention.

Referring to FIG. 4, the cylindrical assembly 104 of the foot member 102 is illustrated. The cylindrical assembly 104 comprises a protuberance member 110, the rotary member and the spring members 112. In one embodiment, the rotary member is configured to move the foot member 102 to the horizontal position. In one embodiment, the spring members 112 coupled to the rotary member is configured to self-retract the foot member 102 from the horizontal position to the vertical position. In one embodiment, the protuberance member 110 is disposed at the cylindrical assembly 104 is configured to acta stopper to hold the step in the vertical position on retraction by the spring members 112.

Figure 5A:
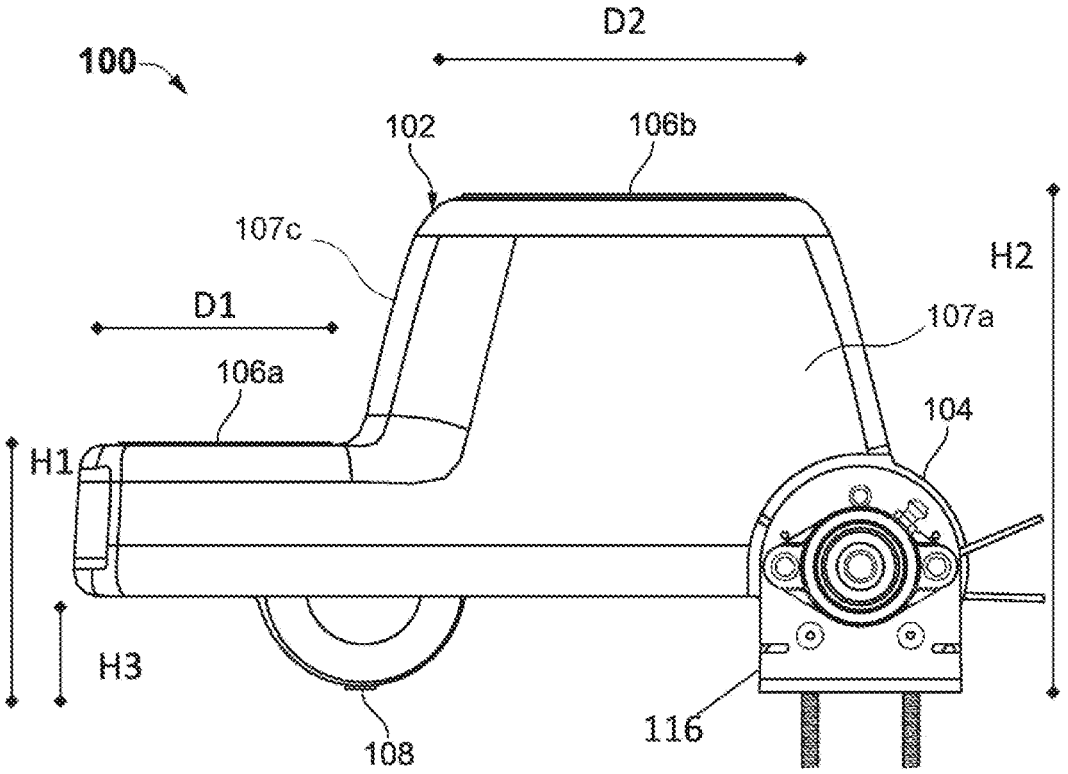
FIGS. 5A-5B exemplarily illustrate a side view and a front view of the self-retractable step, according to one embodiment of the present invention.

Referring to FIG. 5A, a base of the foot member 102 further comprises at least one load bearing member 108, which is adapted to hold the foot member 102 above ground level during horizontal position. In one embodiment, the dimensions of the self-retractable step 100 may varies. In one embodiment, wheels with one or more holes are provided between the cylindrical assembly 104 and the spring members 112 to vary the strength of the spring member 112. In one embodiment, the cylindrical assembly 104 is made of material including, but not limited to, molded plastic. The foot member 102 can be manufactured from various materials. For example, the main body can be made from plastic by roto-molding with anti-slip members 106*a* and 106*b* being glued or bonded thereto. Injection molding of plastic parts can also be suitable to be assembled to form the member 102.

During operation of the present invention, deployment of the foot member 102 is done by placing the foot and pressing downward on at least one step 106. The rotary member moves the foot member 102 from the rest position to the horizontal position due to the force applied by the foot of the user. Further, on removing the foot from the steps 106, the spring members 112 of the cylindrical assembly 104 is adapted to automatically retract the foot member 102 to the rest position.

Advantageously, the present invention assists the user in elevating him or herself above the floor to access the sink. Further, the stair member comprising at least two steps 106 facilitates easy access to the user, such as children or little people, of self-retractable step 100. According to the present invention, the self-retractable functionality allows automatic transition to storage position or vertical position of the self-retractable step 100.

Preferred embodiments of this invention are described herein, including the best mode known to the inventors for carrying out the invention. It should be understood that the illustrated embodiments are exemplary only, and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

Additional features and advantages of the embodiments disclosed above are described below with reference to FIGS. 1-5. In general, the present disclosure relates to a step which may be used by a child to reach a sink. The step may include a mechanism by which it automatically retracts to a rest position when it is not in use. The step 100 may comprise a foot member 102 which is configured to be stood on by a user and a rotation assembly 104 which is configured to allow the foot member to rotate between a rest position and a use position. In some embodiments, the foot member 102 may include a first step 106*a* and a second step 106*b*. In some embodiments, the rotation assembly 104 may be a cylindrical assembly as described above.

As discussed above, the foot member 102 may include two or more steps 106*a*, 106*b* and a load bearing member 108. The steps 106*a*, 106*b* may be covered by a slip-proof material or may be textured during a manufacturing process so that they have slip proof surfaces. The foot member 102 may have a sloped rear surface 118, which may allow the second step 106*b* to be in a forward position relative to a point at which the foot member 102 connects to the rotation assembly 104.

Figure 5B:
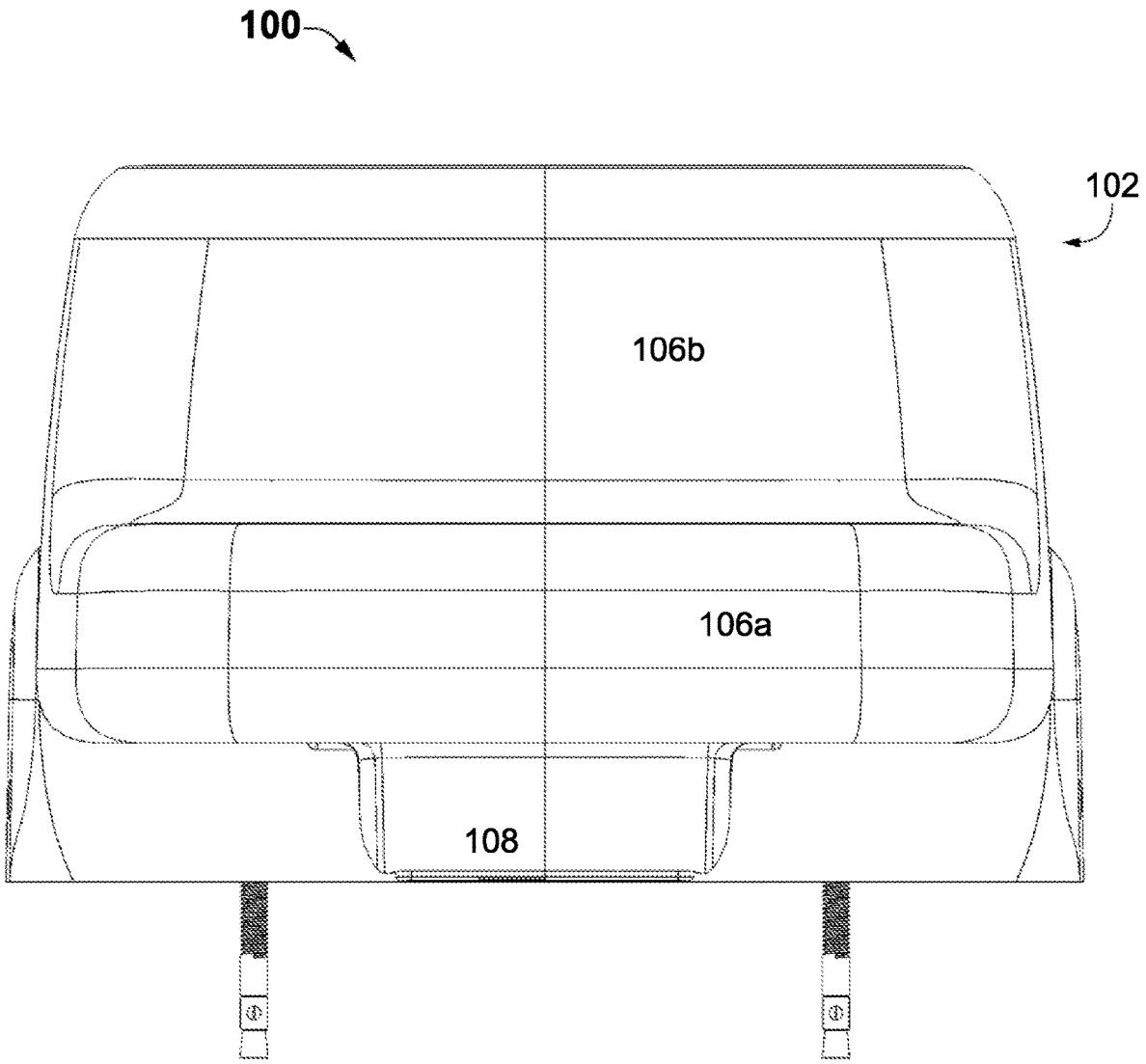

The load bearing member 108 is shown clearly in FIGS. 5A-5B. The load bearing member 108 may extend from a base/a bottom surface of the foot member 102. The load bearing member 108 may be disposed in the center of the foot member 102 relative to the width of the foot member 102, as shown in FIG. 5A. Accordingly, the load bearing member 108 may be disposed at a distance of one inch (2.54 cm) to five inches (12.7 cm) from each lateral edge of the foot member 102. The load bearing member 108 may be offset from a front edge of the foot member 102, as shown in FIG. 5B. Accordingly, the load bearing member 108 may be disposed at a distance of one inch (2.54 cm) to five inches (12.7 cm) from the front edge of the foot member 102. In some embodiments, the load bearing member 108 may be disposed several inches or more from all edges of the foot member 102. This arrangement may prevent users' feet from becoming trapped/pinched under the load bearing member 108 when the foot member 102 is moved into a use position. In some embodiments, the load bearing member 108 may be positioned on the base of the foot member 102 based on manufacturing considerations. For example, the load bearing member 108 may be disposed under both the first step 106*a* and the second step 106*b*. The position of the load bearing member 108 may support weight applied via either step 106*a*, 106*b* and may allow the foot member 102 to be manufactured as a partially or substantially hollow unit.

The rotation assembly 104 may be attached to a fixed surface such as a floor and may allow the foot member 102 to rotate relative to the fixed surface. The rotation assembly 104 may allow the foot member 102 to move between a use position and a rest position. In some embodiments, the use position may be substantially vertical, such that the load bearing member 108 of the foot member 102 rests on the floor. In some embodiments, the rest position may be substantially horizontal, such that the foot member 102 extends upwards from the rotation assembly. For example, FIG. 1B illustrates a first step 100 (front) in a use position and a second step 100 (rear) between a use position and a rest position.

The rotation assembly 104 may be automatically retract the foot member 102 from the use position to the rest position when the step 100 is not in use; when the step 100 is not in use, the foot member 102 may be maintained in the rest position. A user may move the foot assembly 102 into the use position by using their foot to pull down on the first step 106*a*. A user may then maintain the foot assembly 102 in the use position by standing on the foot assembly 102. When the user steps off of the foot assembly 102, the rotation assembly may retract the foot assembly 102 to the rest position. In this case, a "user" may encompass more than one person. For example, an adult may move the foot member 102 into the use position and a child may then use the step 100. The mechanism described above may improve the hygiene of the step 100 by prevent a user's hands from coming in contact with the step 100. It may also improve convenience and safety by automatically moving the step 100 to an unobtrusive rest position when it is not in use.

As discussed above, the rotation assembly 104 may include a rotary member 120. The rotary member 120 may be configured to allow the foot member 102 to rotate relative to fixed surface to which the rotation assembly 104 is attached. In some embodiments, as shown in FIG. 3, the rotary member 120 may be a shaft. One or more biasing members 112, or spring members, may be attached to the rotary member 120 to automatically retract the step member 102 when a user isn't standing on the step member 102. In some embodiments, the biasing members 112 may be torsion springs, as shown in FIG. 3. The biasing members 112 may also be torsion rods, pneumatic mechanisms, or any other biasing means known in the art. In some embodiments, dampeners may be attached to the biasing members to modulate the movement of the step member 102. In some embodiments, a motor may be used to automatically retract the step member 102. The motor may be activated by a motion or weight sensor.

The rotation assembly 104 may also include a housing. The housing may comprise a plate 122, an upper surface 124, and one or more end plates 132. The plate 122 may be configured to be attached to a fixed surface such as a floor. As shown in FIG. 3, the plate 122 may be attached to a floor using one or more bolts 126 and nuts 128. The plate 122 may also be attached to the floor using any other means known in the art. The plate 122 may include vertical extensions 130 which attach to other components of the rotation assembly 104.

The upper surface 124 may comprise a generally curved or cylindrical surface. The upper surface 124 may mate with a curved extension (not shown) disposed on a back side of the step member. As shown in FIG. 2, the upper surface 124 of the rotation member 104 may form fit snugly with the foot member 102, while still allowing smooth rotation between the foot member 102 and the rotation assembly 104. The snug fit may prevent things such as shoelaces or children's fingers from becoming caught in the step 100. It may also improve the ease and thoroughness with which the step 100 may be cleaned.

The upper surface 124 may be connected to and/or formed in one piece with the end plates 132. As shown in FIG. 3, the end plates 132 may be connected to the plate 122 via one or more bolts and nuts or any other means known in the art. This may provide the necessary connection between the plate 122, the remaining components of the rotation assembly 104, and the foot member 102. The upper surface and the end plates 132 may form a continuous, curved surface that is easy to clean and free of potentially dangerous sharp edges.

FIGS. 1-5 show exemplary dimensions of the step 100 and the environment in which it may be installed. In general, the dimensions of the step 100 may be chosen such that the step 100 may be readily used by a child to reach a sink in a bathroom. The dimensions may also be chosen such that the step 100 may be not be obtrusive to adults using the sink or cleaning around the sink when it is not in use.

FIGS. 1-5 show nine dimensions of the step 100: an overall length of the step 100 in a use position, L; an overall height of the step 100 in a rest position, H; a width of the foot member 102, W1; a width of the rotation assembly 104, W2; a height of the first step 106*a* of the foot member 102, H1; a height of the second step 106*b* of the foot member 102, H2; a height of the load bearing member 108 of the foot member 102, H3; a depth of the first step 106*a* of the foot member 102, D1; and a depth of the second step 106*b* of the foot member 102.

W1 may be chosen such that the foot member 102 is stable for a child to stand on and W2 may be chosen such that the rotation assembly 104 provides necessary support to the foot member 102. In some embodiments, W1 may be between 9 inches (22.86 cm) and 20 inches (50.8 cm), between 10 (25.4 cm) inches and 18 inches (45.72 cm), or between 12 inches (30.48 cm) and 14 inches (35.56 cm). In some embodiments, W2 may be about two inches (5.08 cm) to six inches (15.24 cm) greater than W1 or about three inches (7.62 cm) to five inches (12.7 cm) greater than W1.

H1 and H2 may be chosen such that the foot member 102 may be readily used by a child to reach a sink; in other words, H1 and H2 are low enough that a child may readily climb them and high enough that a child may use them to reach a sink. H3 may be chosen such that the foot member 102 is high enough off of the ground to not pinch a user's foot underneath. In some embodiments, H2 may be between 6 inches (15.24 cm) and 15 inches (38.1 cm), between 9 inches (22.86 cm) and 12 inches (50.8 cm), or approximately 10 inches (25.4 cm). In some embodiments, H1 may be between 25% and 75% of H2, between 40% and 60% of H2, or approximately 50% of H2. In some embodiments, H1 may be approximately five inches (12.7 cm). In some embodiments, H3 may be between zero and four inches (10.16 cm) or approximately two inches (5.08 cm).

D2 may be chosen such that a child may stably stand on the second step 106*b* of the foot member 102. D1 may be chosen such that a child may readily step from the first step 106*a* to the second step 106*b*, and may or may not be able to stand stably on the first step 106*a*. In other words, the D1 may be small enough that a small child may use the first step 106*a* as a step, but may not stand on it. A child whose feet are too large to use the first step 106*a* as a step may be tall enough to step directly onto the second step 106*b*. In some embodiments, D2 may be between four inches (10.16 cm) and fifteen inches (38.1 cm), between six inches (15.24 cm) and twelve inches (50.8 cm), or approximately eight inches (20.32 cm). In some embodiments, D1 may be between 25% and 100% of D2, between 50% and 80% of D2, or approximately 65% of D2. In some embodiments, D1 may be approximately two inches (5.08 cm). By making D1 smaller than D2, the force of the biasing mechanism needed to lift the step 100 can be reduced and the position of the load bearing member 108 can likewise be positioned closer to the axis of rotation.

D1 and D2 contribute to the overall length L/upright height H of the step 100. With reference to FIGS. 1A and 1B, it can be seen that the length L of the step 100 measured when the step 100 is in a use position is roughly equal to the upright height H of the step 100 measured when the step 100 is in a rest position. Minimizing the length L/upright height H of the step 100 may make the step 100 more compact and therefore easier to work around in a public bathroom. This may improve the ease with which the area around the step 100 can be cleaned. It may also prevent the foot member 102 of the step 100 from contacting a sink under which the step 100 is located when the step 100 is in a rest position. The upright height H may be selected such that the step 100 does not interfere with the sink or any pipes, etc. under the sink. For example, the upright height H may be substantially less than a height of the sink under which it is installed. Minimizing the length L/upright height H of the step 100 may also reduce the overall weight of the foot member 102 and may thereby reduce the force which the rotation assembly 104 must apply to retract the foot member 102.

With reference to FIGS. 1A and 1B, the step 100 may also be positioned relative to the sink 114 under which it is installed in a manner which minimizes interference with persons using the sink. In particular, the leading edge 116 of the rotation assembly 104 (see FIG. 5) may be positioned at a distance behind a front edge of the sink 114. The distance may be chosen such that an adult using the sink does not contact the step 100 with their feet or legs when the step 100 is in a rest position. The step 100 may be configured such that when it is in the rest position, the entire foot member is vertically in line or behind with the leading edge 116 of the rotation assembly 104. In some embodiments, a portion of the foot member 102, such as the load bearing member 108, may extend in front of the leading edge 116 of the rotation assembly. In some embodiments, The leading edge 116 of the rotation assembly 104 may be installed between zero inches to 12 inches (50.8 cm) behind the front edge of the sink 114, between two inches (5.08 cm) and eight inches (20.32 cm) behind the front edge of the sink 114, or between three and four inches (7.62-10.16 cm) behind the front edge of the sink 114.

The step 100 may be installed using any means known in the art. As discussed above, it may be installed in a bathroom, especially a public bathroom, proximate a sink. Exemplary methods of installing the step are described below with reference to FIGS. 1-5. An installation location may be chosen based on the parameters described above. For example, the installation location may position the leading edge of the rotation assembly three to four inches behind a front edge of the sink. A plate 122 of a rotation assembly 104 may be mounted at the installation location using nuts and bolts or any attachment means known in the art. The step member 102 and the components of the rotation assembly 104, excluding the plate 122 may be assembled with each other. Assembly may be performed prior to installation of the step 100 or as part of the same process as the installation. The end plates 132 may or may not be assembled with the other components discussed above. The assembled components may be disposed over the installed plate 122, such that the components of the rotary member 120 and other components of the rotation assembly 104 mate with the vertical extensions 130 of the plate 122. In some embodiments, the rotary member 120 and/or the spring members 112 may be connected to the vertical extensions 130. If the end plates 132 are not previously assembled with the other components, they may be disposed at the ends of the upper surface 122. Nuts and bolts or any other means known in the art may be used to secure the end plates 132 to the plate 122.

FIGS. 6-7 illustrate additional embodiments of the self-retractable step 100. One skilled in the art will recognize that features illustrated in different figures and discussed with different embodiments may be combined with each other without departing from the scope of the present disclosure.

Figure 6A:
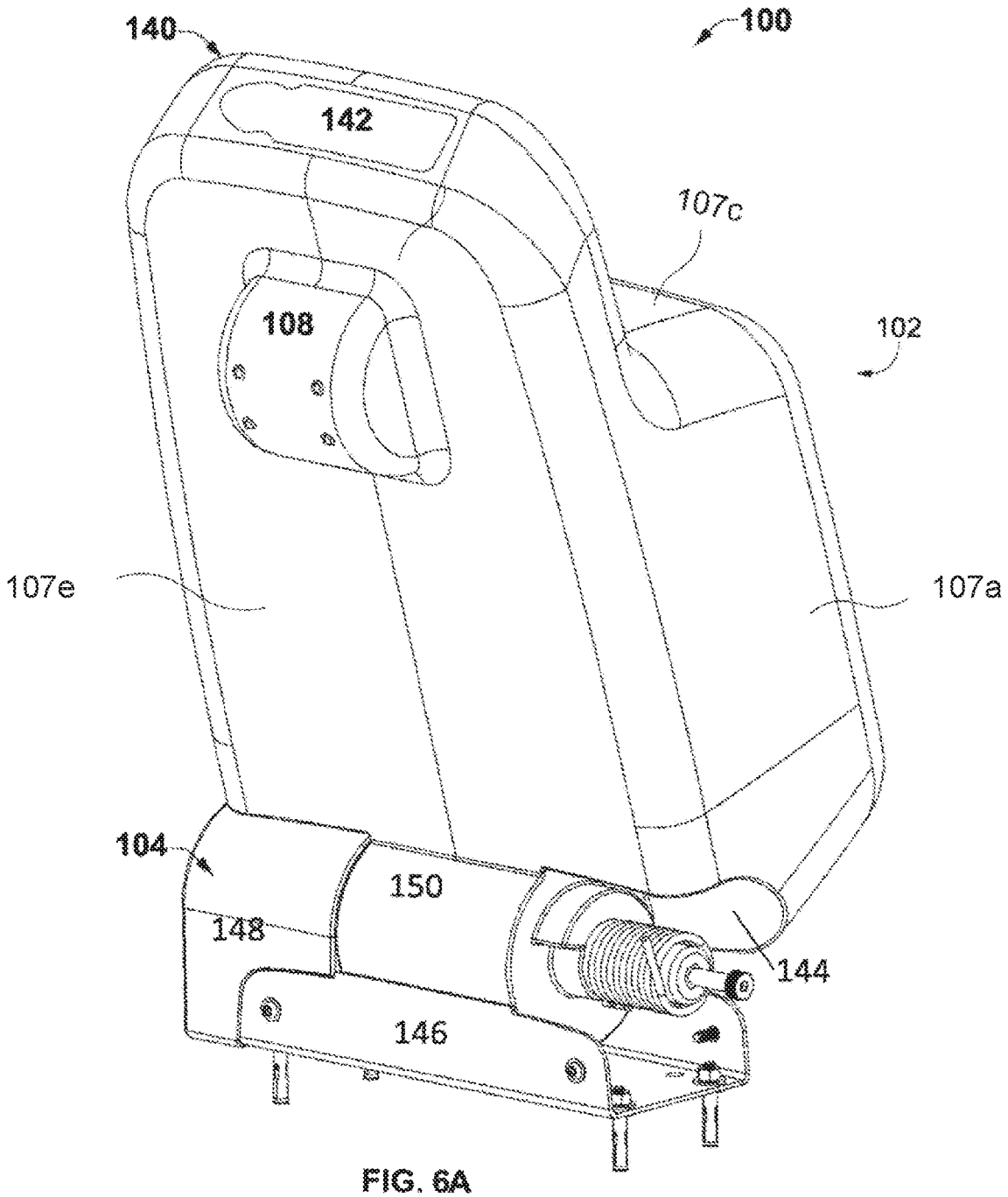
FIG. 6A exemplarily illustrates a partially assembled view of a self-retractable step according to the present disclosure.
Figure 6B:
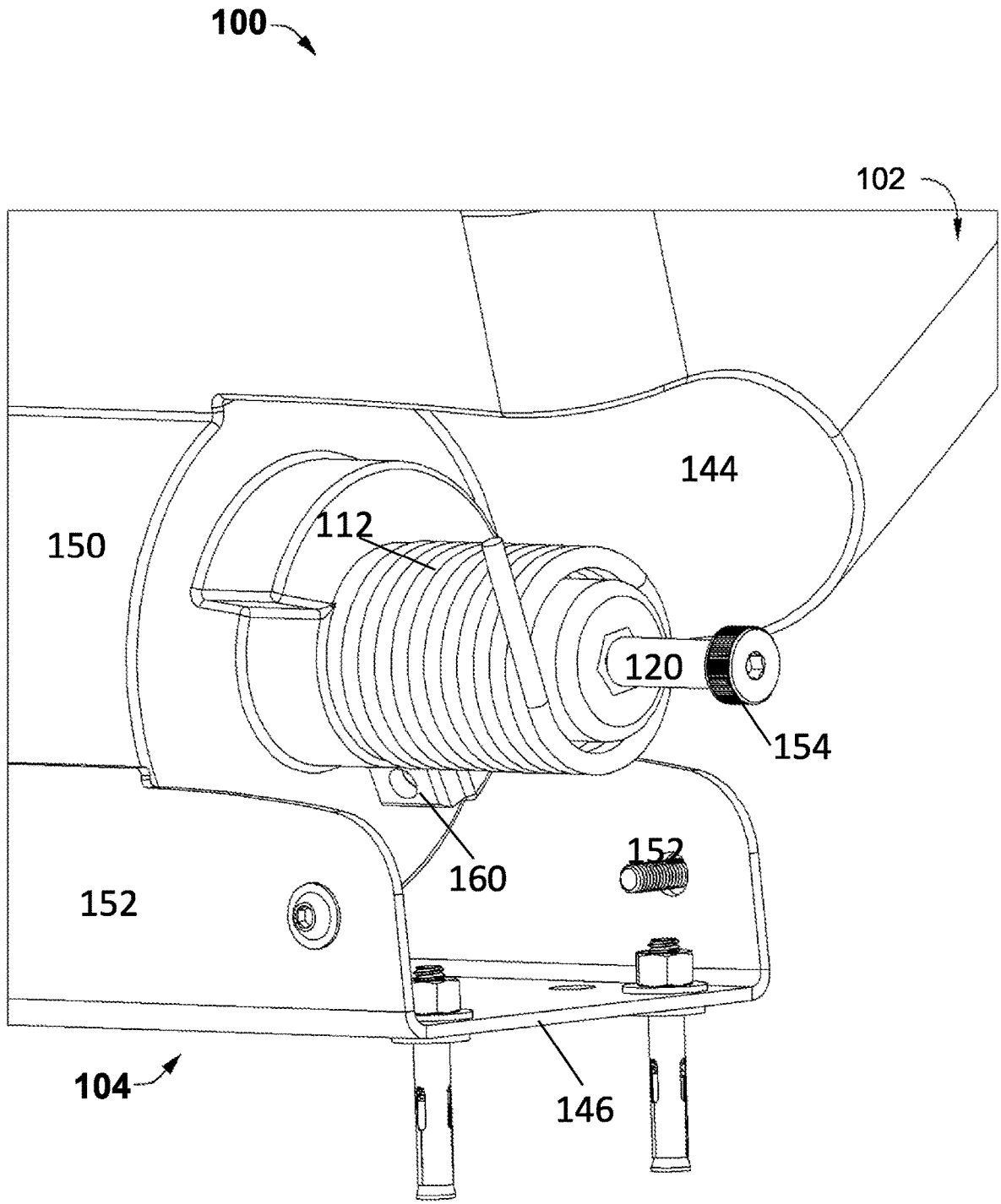
FIG. 6B exemplarily illustrates a close-up partially assembled view of a self-retractable step according to the present disclosure.
Figure 6C:
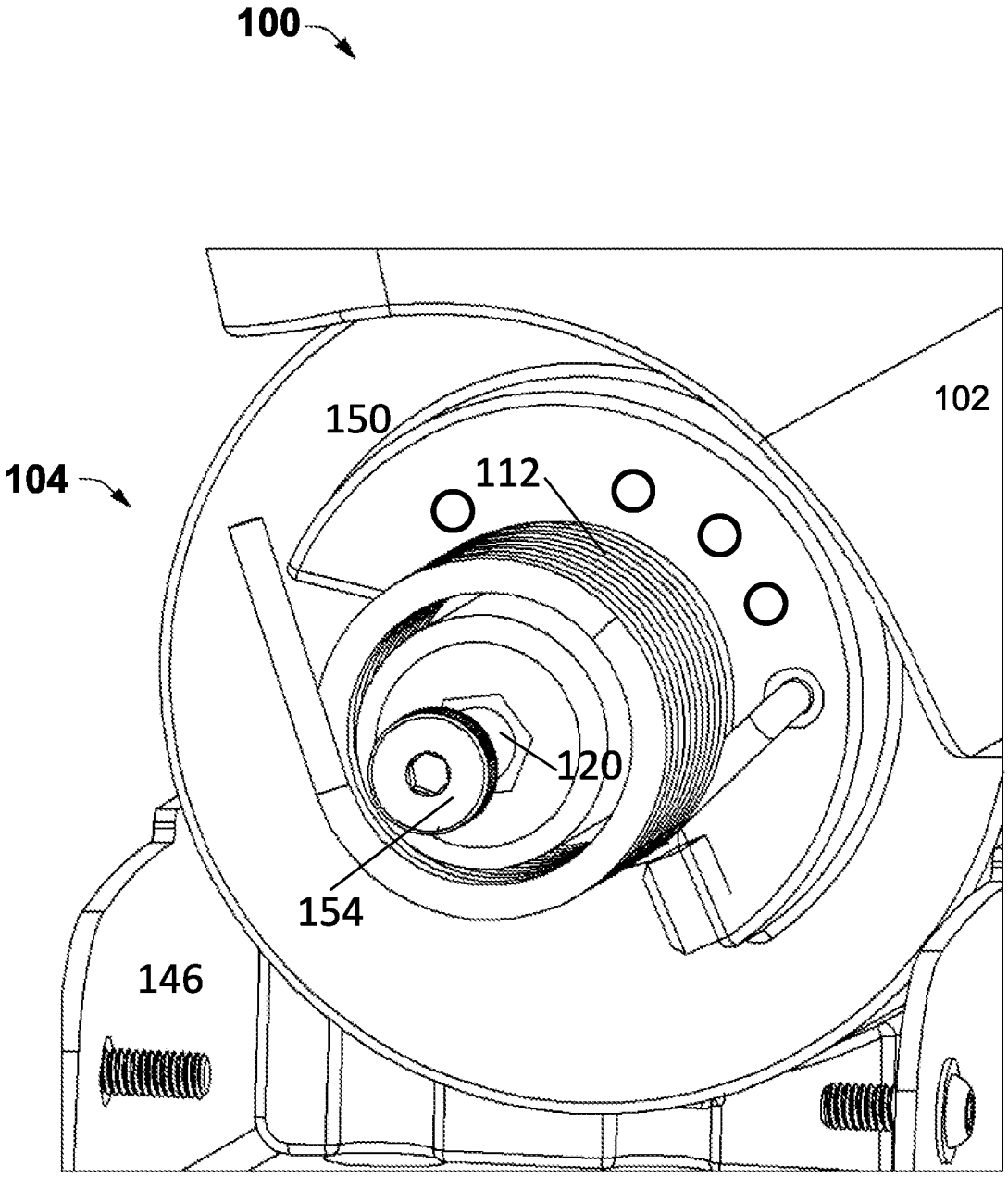
FIG. 6C exemplarily illustrates a close-up partially assembled view of the self-retractable step showing multiple holes for receiving a biasing member according to the present disclosure.

FIGS. 6A-6C illustrate a self-retractable step 100 including a foot member 102 and a rotation assembly 104. The foot member 102 may be similar to the foot member 102 described above. The foot member 102 may include an angled front edge 140, which may be angled such that a user can read instructions 142 displayed thereon when the foot member 102 is in a rest position. The foot member 108 may also include a load bearing member 108 disposed on a bottom face. The load bearing member 108 have rounded edges, which may make cleaning the self-retractable step 100 easier. The load member 108 may include extensions formed on a bottom surface and configured to contact the ground, as shown in FIG. 6A.

The foot member may include a curved face 144 and a rotational extension 150 at a rear position. The curved face 144 may be configured to mate with complementarily curved portions of the rotation assembly 104 which will be described in detail below. The rotational extension 150 may be generally cylindrical as shown in FIGS. 6A-6C or may have any other shape which allows rotation.

The foot member 102 may be manufactured through any means known in the art. Such means may include blow molding, injection molding, rotational molding, three-dimensional printing, and traditional machining. In some embodiments, the foot member 102 may be substantially hollow. The foot member 102 may comprise an outer wall and may have internal walls, such that internal cavities are formed within the foot member. In some embodiments, the outer wall of the foot member 102 may be approximately 1/16 inch thick. The structure and material of the foot member 102 may allow it to be lightweight.

The rotation assembly 104 may include a housing which contains internal components. The housing of the rotational assembly 104 may comprise a plate 146 and two end pieces 148. These components are shown in more detail in FIGS. 7A-7C.

The internal components may include one or more biasing members 112 and one or more rotary members 120. The biasing members 112 may comprise torsion springs as shown in FIGS. 6A-6C, or any other biasing means, such as elastic members, pneumatic members, or motors. The biasing members 112 may be attached to the rotational extension 150 of the foot member 102 at one end. The other end of the biasing member 112 may engage the end pieces 148 of the housing. In some embodiments, as shown in FIG. 6C, the rotational extension 150 may include multiple holes to which the biasing member 112 may be attached. Attaching the biasing member 112 to different holes may change the force which the biasing member 112 applies to retract the foot member 102.

In some embodiments, as shown in FIGS. 6A-6C, the rotary members 120 may be rigidly attached to the rotational extension 150 of the foot member 102 and may be rotationally connected to the end pieces 148 via bearings 154. In some embodiments, the rotary members 120 may be rigidly attached to the end pieces 148 and rotationally connected to the foot member 102.

Figure 7A:
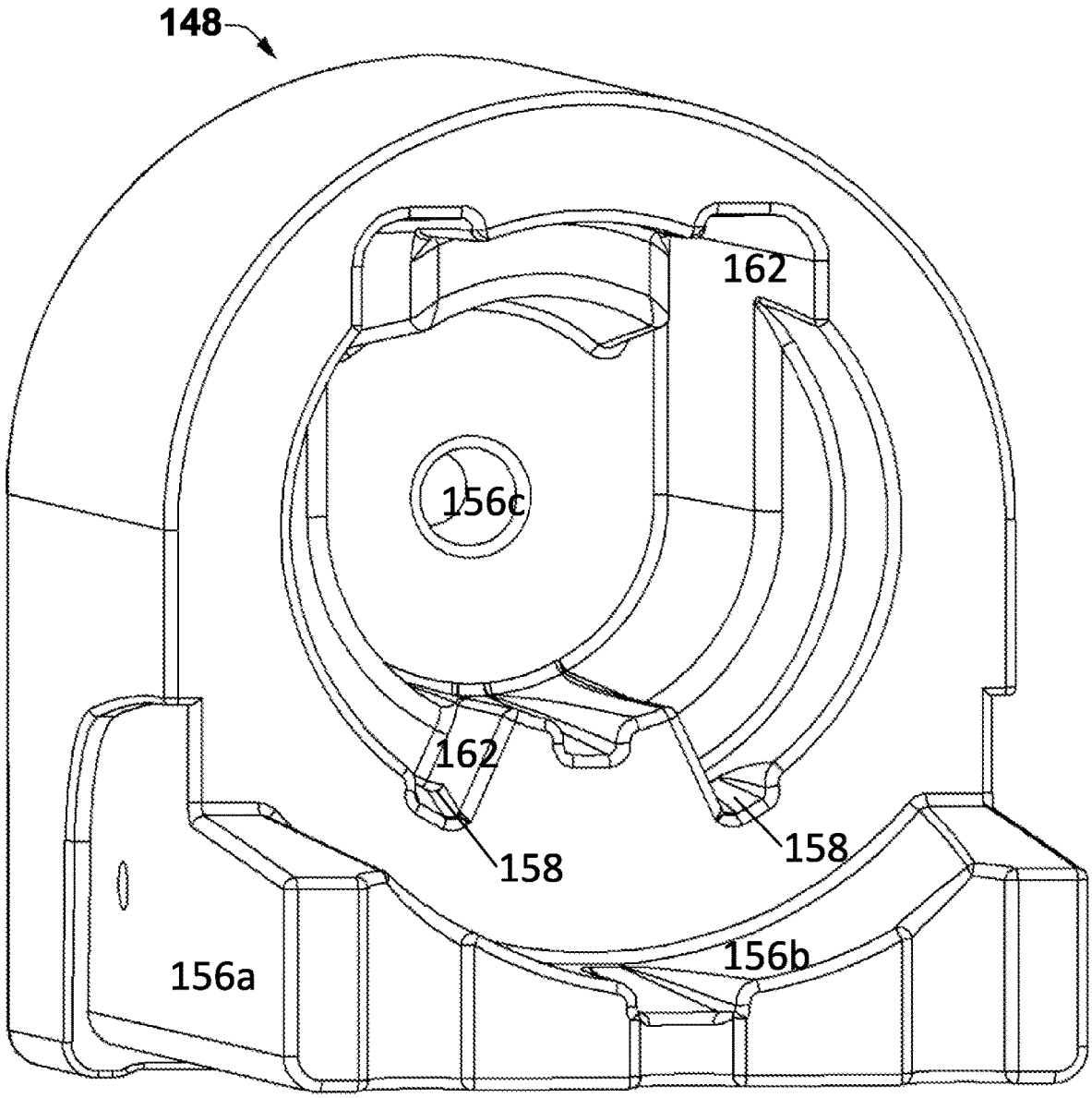
FIG. 7A exemplarily illustrates an end piece in accordance with the present disclosure.
Figure 7B:
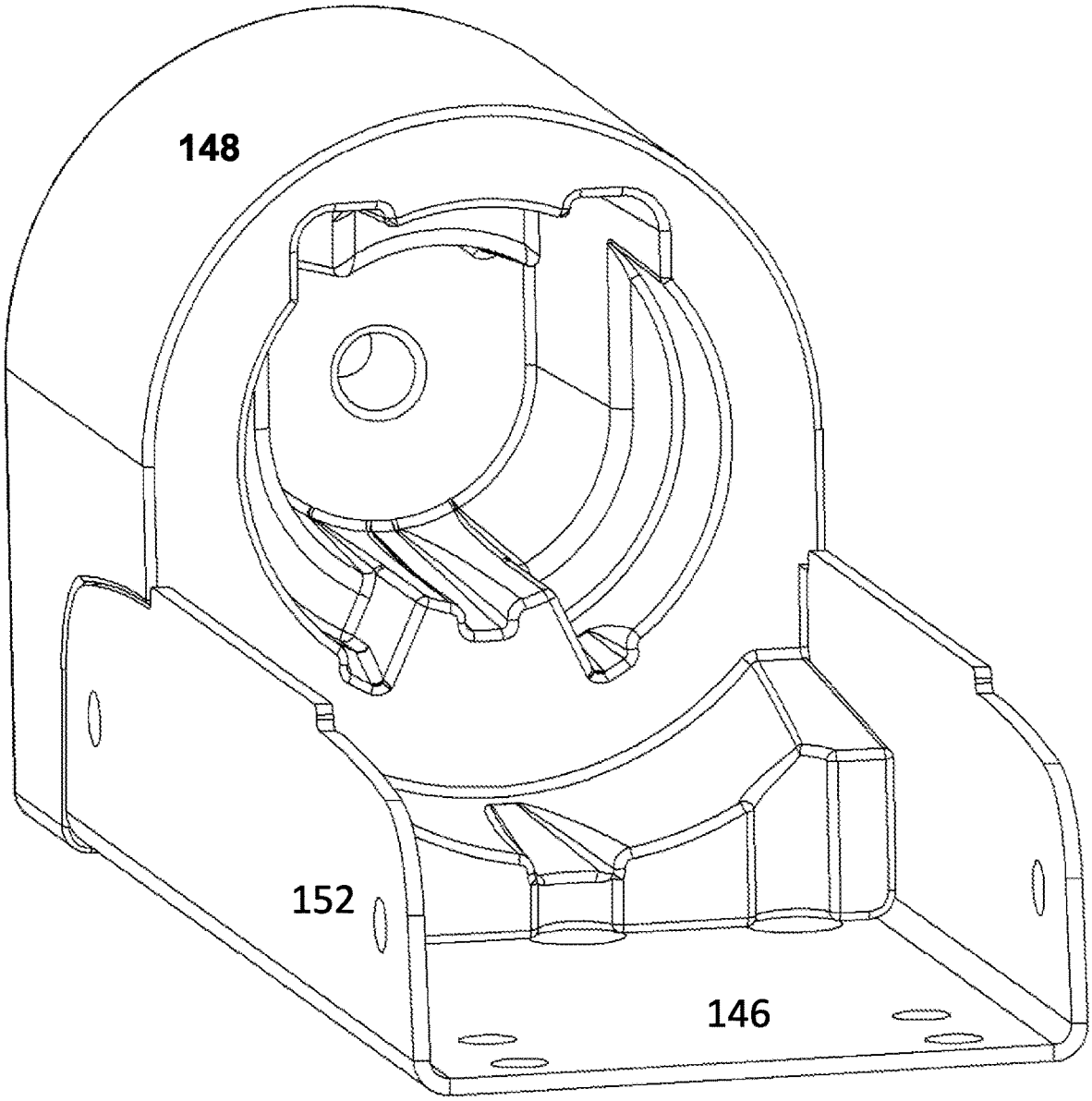
FIG. 7B exemplarily illustrates an end piece and a plate in accordance with the present disclosure.
Figure 7C:
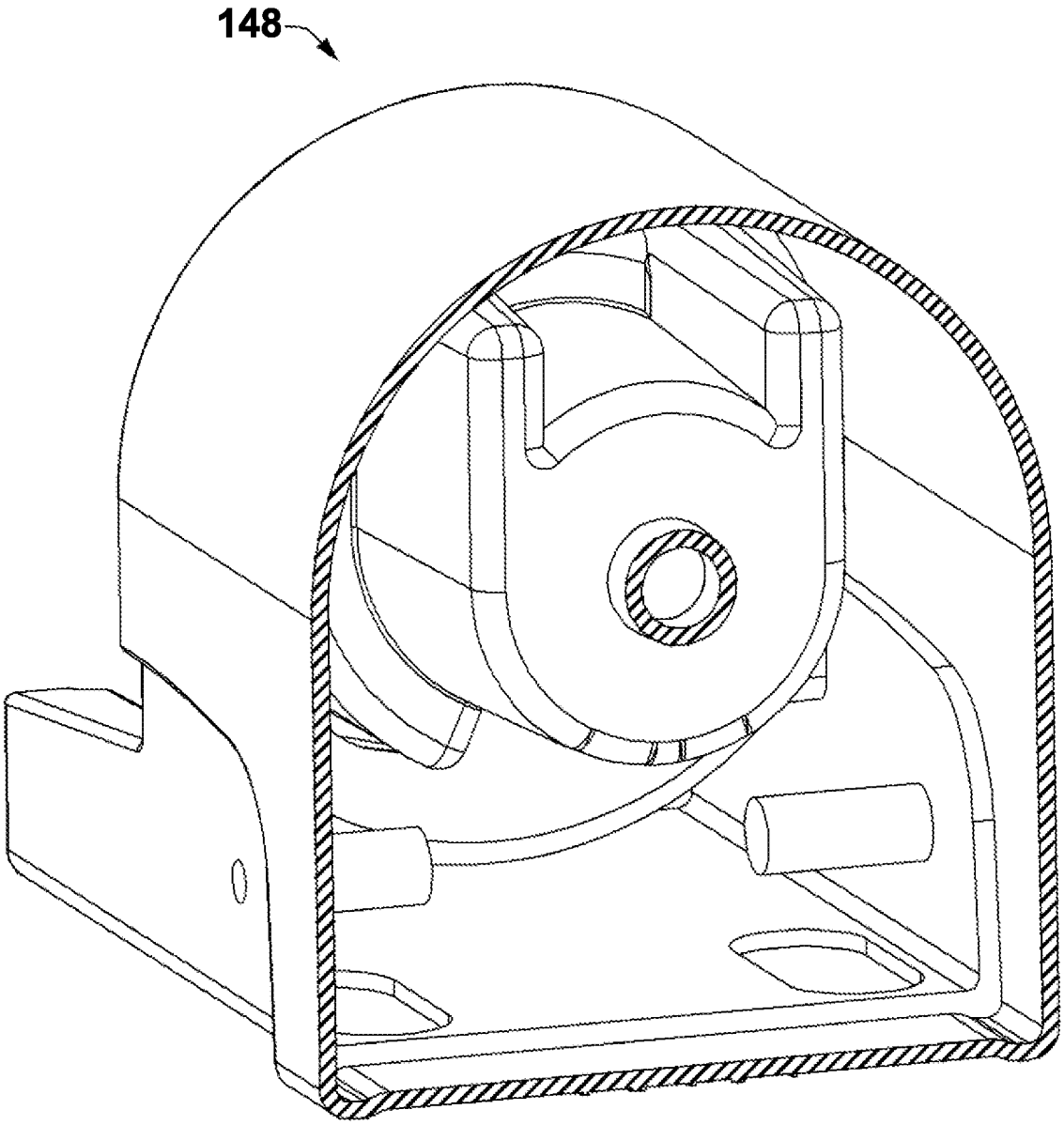
FIG. 7C exemplarily illustrates a cross-section view of an end piece in accordance with the present disclosure.

FIGS. 7A-7C show the housing of a rotational assembly 104. As discussed above, the housing may include a plate 146 and two end pieces 148. The plate 146 may be configured to be attached to a bathroom floor or other horizontal surface. In some embodiments, the plate may be attached to the surface via bolts and nuts as shown in FIG. 6B or through any other means known in the art. The plate 146 may comprise vertical extensions 152 configured to attach to the end pieces 148 via bolts, as shown in FIG. 6B, or through any other means known in the art. The vertical extensions 152 may comprise curved or angled corners and may have straight upper edges. The straight upper edges may mate closely enough with the rotation extension 150 to prevent items from becoming trapped between the rotation extension 150 and the vertical extensions 152.

The end pieces 148 may include surfaces 156*a*, 156*b* configured to mate with the plate 146 (surface 156*a*), the rotational extension 150 of the foot member 102 (surface 156*b*), the bearing 154 (surface 156*c*). The surface 156*a* which mates with the plate 146 may comprise a recess, such that an external surface of the plate is flush with an external surface of the end piece 148. The surface 156*a* may include one or more mating structures, such as bolt holes, so that the plate 148 may be rigidly attached to the end piece 148. The end pieces 148 may also comprise internal notches 158 configured to engage the biasing members 112. The biasing members 112 may be torsion springs and the internal notches 158 may hold the ends of the biasing members 112.

One skilled in the art will recognize that the shape of the end pieces 148 is determined based on other components of the self-retractable step 100. Accordingly, if other components are changed from what is shown in FIGS. 6-7, the end pieces 148 may be different than shown. For example, if the biasing members 112 are elastic members instead of torsion springs, the end pieces 148 may include attachment points of the elastic members instead of or in addition to the internal notches 158. One skilled in the art will be able to readily envision other such modifications.

The end pieces 148 and the rotational extension 150 may be configured to prevent rotation of the foot member 102 beyond a certain point. As shown in FIGS. 6A-6C, the rotational extension 150 may include a stopper 160. As shown in FIGS. 7A-7C, the end pieces 148 may include complementary surfaces 162 which engage the stoppers 160. In some embodiments, engagement of the stoppers 160 and the complementary surfaces 162 may hold the foot member 102 in a rest position.

The rotational assembly 104 may be manufactured through any means known in the art. In some embodiments, the plate 146 may comprise machined sheet metal and the end pieces 148 may comprise plastic. The end pieces 148 may be formed through rotational molding, injection molding, or any other means known in the art. Some portions of the end pieces 148 may be reinforced using metal or another material. The rotational assembly 104 may generally be manufactured to be both sturdy and lightweight. For example, the end pieces 148 may be substantially hollow as shown in FIG. 7C. In some embodiments, the end pieces 148 may comprise an external wall approximately 1/16 inches thick. The external surface of the rotational assembly 104, namely the housing, may be manufactured to have mostly or only curved surfaces. This may make the housing easier to clean and may prevent fingers, feet, clothing, or anything else from becoming caught in the self-retractable step.

The step 100 may be installed using any means known in the art. As discussed above, it may be installed in a bathroom, especially a public bathroom, proximate a sink. Exemplary methods of installing the step are described below with reference to FIGS. 6-7. An installation location may be chosen based on the parameters described above. For example, the installation location may position the leading edge of the rotation assembly three to four inches behind a front edge of the sink. A plate 146 of a rotation assembly 104 may be mounted at the installation location using nuts and bolts or any attachment means known in the art. The step member 102 and the components of the rotation assembly 104, excluding the plate 122 may be assembled with each other. The biasing members 112 may be connected to particular holes in the rotation extension 150 to provide appropriate stiffness in some embodiments. Assembly may be performed prior to installation of the step 100 or as part of the same process as the installation. The assembled components may be disposed over the installed plate 146, such that the end pieces 148 mate with the vertical extensions 152 of the plate 146. Nuts and bolts or any other means known in the art may be used to secure the end pieces 148 to the plate 146.

Advantages of the self-retracting step disclosed herein have been described throughout the disclosure. They are summarized here for convenience. The step may improve convenience in a bathroom by allowing a child to access a regular sink. It may also improve safety and hygiene by allowing the step to be positioned in a use position using only the foot of a user and by automatically retracting the step when it is not in use. It may have a relatively small footprint and be easy to clean and maintain. The step may also be configured such that feet and clothing cannot become caught in or under it.

What is claimed is:

1. A retractable step for assisting a user in elevating him or herself above a floor, comprising:

a foot member comprising:

at least a first step and a second step, wherein the first step and the second step are rigidly connected to one another; and a load bearing member disposed on a base of the foot member at a forward end of the foot member; and a rotation assembly coupled to the foot member, located near a rear end of the foot member, and configured to be mounted on a fixed horizontal surface of said floor, comprising a rotary member configured to allow the foot member to rotate from a use position in which the load bearing member can engage the fixed horizontal surface to a rest position relative to the fixed horizontal surface, a stop preventing rotation from said use position beyond said rest position, in which said foot member is inclined towards said user from a vertical orientation with said first step positioned to be forward of said second step and said rotation assembly and with said first step exposed to be accessible from above, wherein deployment of the foot member from the rest position to the use position can be performed by placing a foot of the user on the first step of the foot member and pressing downwards.

2. The retractable step according to claim 1, wherein the rotation assembly is a cylindrical assembly.

3. The retractable step according to claim 1, wherein the rotation assembly comprises a retraction mechanism configured to retract the foot member from the use position to the rest position.

4. The retractable step according to claim 3, wherein the retraction mechanism comprises one or more biasing members.

5. The retractable step according to claim 4, wherein the one or more biasing members are spring members.

6. The retractable step according to claim 1, wherein said stop comprises a protuberance member disposed at the rotation assembly to hold the foot member in the rest position.

7. The retractable step according to claim 4, wherein the rotation assembly further comprises one or more dampeners attached to the biasing members.

8. The retractable step according to claim 3, wherein the retraction mechanism comprises a motor.

9. The retractable step according to claim 1, wherein the rotation assembly is configured to support a load applied via the foot member.

10. The retractable step according to claim 1, wherein the first step has a height of five inches (12.7 cm) and a depth of four inches (10.16 cm) and the second step has a height of ten inches (25.4 cm) and a depth of six inches (15.24 cm).

11. The retractable step according to claim 1, wherein the rotation assembly comprises a curved upper surface and the foot member comprises a curved surface which mates with the curved upper surface of the rotation assembly.

12. The retractable step according to claim 1, wherein a depth of the first step is between 50% and 80% of a depth of the second step.

13. The retractable step according to claim 1, wherein the load bearing foot member is disposed at a distance from a front edge of the foot member and at a distance from two side edges of the foot member.

14. The retractable step according to claim 1, wherein the foot member comprises an angled front edge, angled such that a user can read instructions displayed on the angled front edge when the foot member is in a rest position.

15. The retractable step according to claim 1, wherein the foot member comprises a closed body.

16. The retractable step according to claim 15, wherein said closed body comprises a continuous closed surface defining:

the first step on an upper and front side of said body when the body is in the use position, the second step backward and upward relative to the first step when the body is in the use position, a bottom wall having the load bearing member; and a side wall extending from side edges of the second step to the bottom wall and comprising a riser between the first step and the second step;

wherein the first step, the second step and a front portion of the side wall including the riser are free of holes or recesses.

17. The retractable step according to claim 16, wherein the body comprises an angled front edge.

18. The retractable step of claim 16, wherein said body is free of holes or recesses except for where it couples to said rotation assembly, and said rotation assembly is covered by a second continuous surface that is configured to mate with the continuous surface of the body.

19. The retractable step of claim 16, wherein the rotation assembly comprises a retraction mechanism configured to retract the body from the use position to the rest position.

20. The retractable step of claim 16, wherein the load bearing member is disposed at a distance from a front edge of the body and at a distance from two side edges of the body.

* * * * *